US006146119A

United States Patent [19]

Bush et al.

[11] Patent Number: 6,146,119

[45] Date of Patent: Nov. 14, 2000

[54] PRESSURE ACTUATED SEAL

[75] Inventors: James W. Bush, Skaneateles; Stephen L. Shoulders, Baldwinsville, both of N.Y.; Thomas R. Barito, Arkadelphia, Ark.

[73] Assignee: Carrier Corporation, Farmington, Conn.

[21] Appl. No.: 08/972,642

[22] Filed: Nov. 18, 1997

[51] Int. Cl.[7] ..... F01C 1/02

[52] U.S. Cl. ..... 418/55.4; 418/55.5; 418/57

[58] Field of Search ..... 418/55.4, 55.5, 418/57

[56] References Cited

U.S. PATENT DOCUMENTS

| | | | |
|---|---|---|---|
| 5,588,820 | 12/1996 | Hill et al. | 418/55.5 X |
| 5,613,841 | 3/1997 | Bass et al. | 418/55.5 X |
| 5,833,442 | 11/1998 | Park et al. | 418/55.5 X |
| 5,833,443 | 11/1998 | Lifson | 418/55.5 X |

*Primary Examiner*—Hoang Nguyen

*Attorney, Agent, or Firm*—Howard & Howard

[57] ABSTRACT

A scroll compressor (10) is disclosed which incorporates, in the first embodiment, a floating seal (50) having an inner face seal (52) and an outer face seal (54). The floating seal also has inner and outer diametric seals (58, 60) to seal against the walls of a recess (41) in the crankcase (36). The axial thickness of the floating seal exceeds the depth of the recess. As the scroll compressor undergoes start-up, the orbiting scroll element (14) is forced against the face seals (52, 54) to create a sealed chamber (40). Intermediate pressure from a compression pocket between the scroll elements pressurizes chamber (40) defined between the seals to force the orbiting scroll element (14) into engagement with the fixed scroll element (12). In a second embodiment, a floating seal (80) uses actuator piston (88) which is urged into continuous sealing contact with the orbiting scroll element (14) by an actuator spring (92) to create a sealed chamber. Upon start-up, the chamber (96) is provided with intermediate pressure gas which urges the orbiting scroll element (14) into engagement with the fixed scroll element (12).

15 Claims, 9 Drawing Sheets

Fig-8A
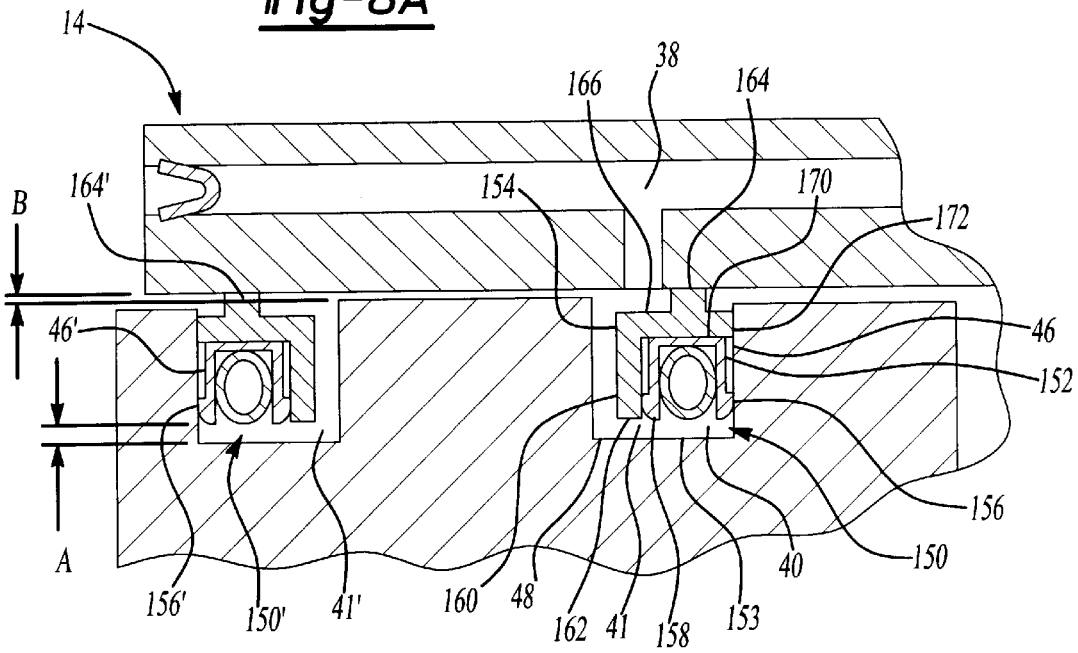
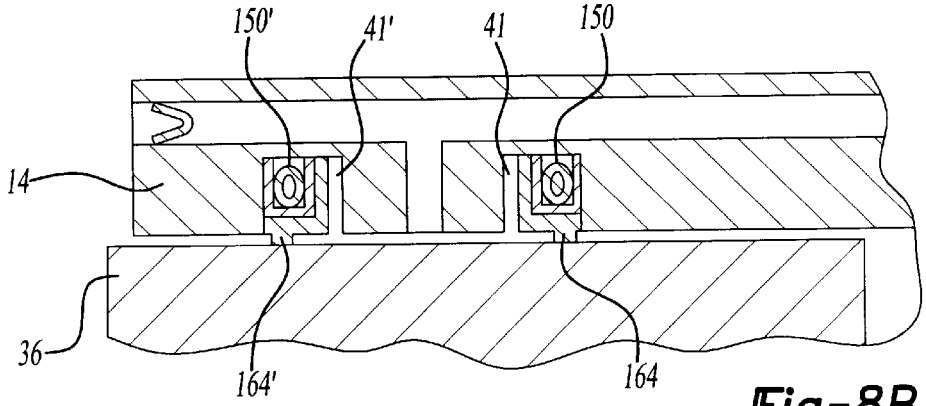
Fig-8B
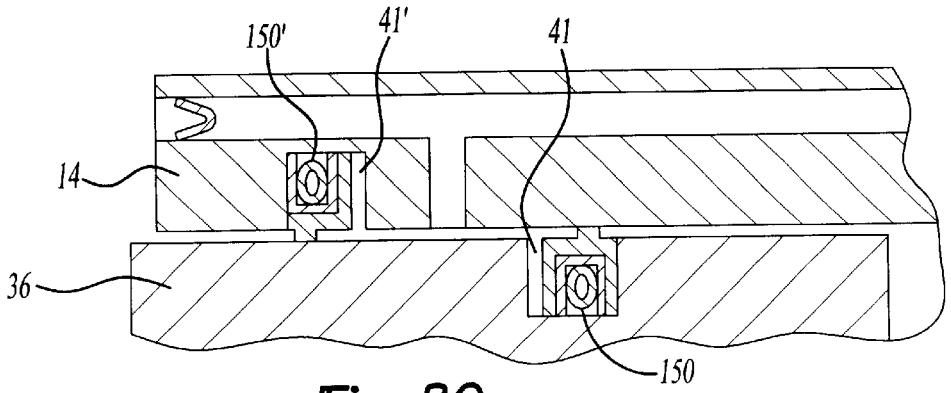
Fig-8C

Fig-9
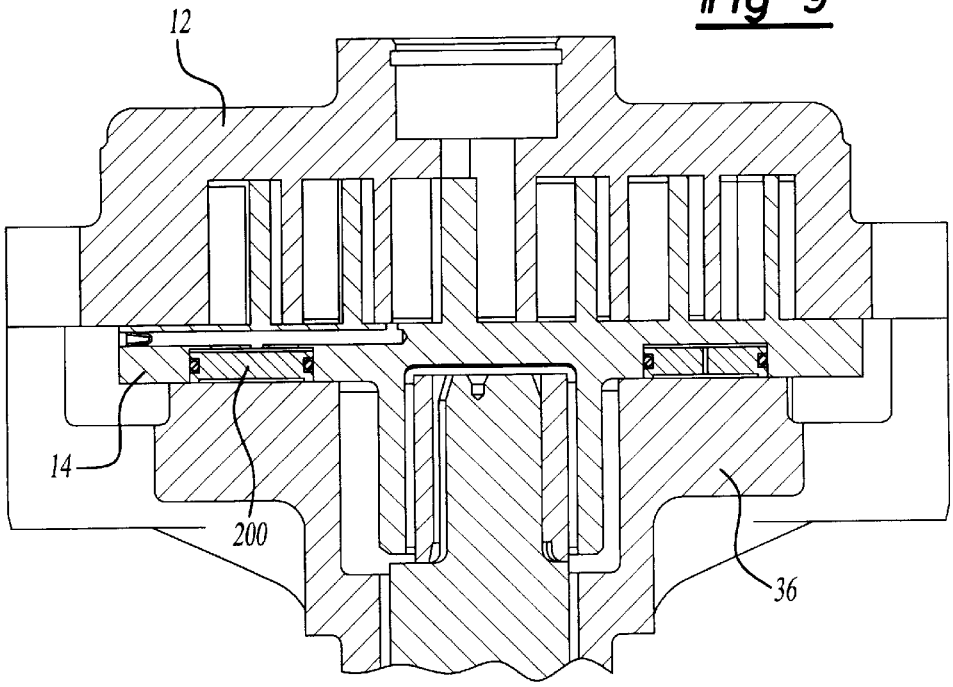
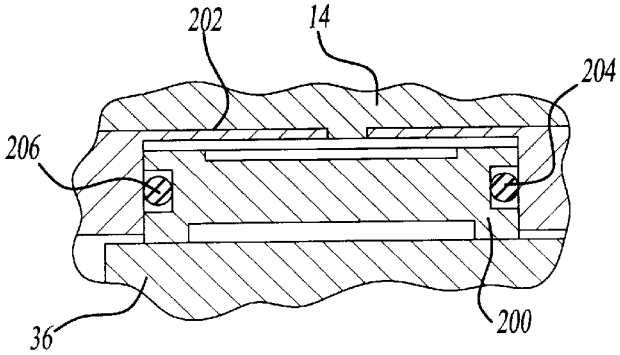
Fig-9A
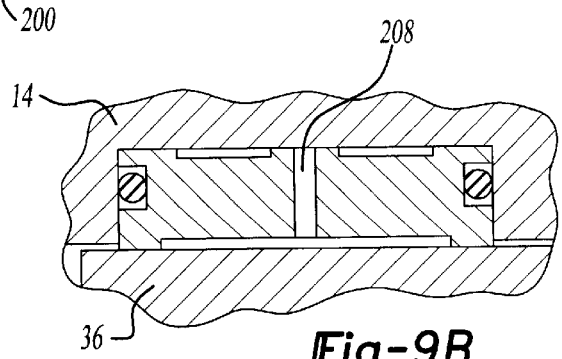
Fig-9B
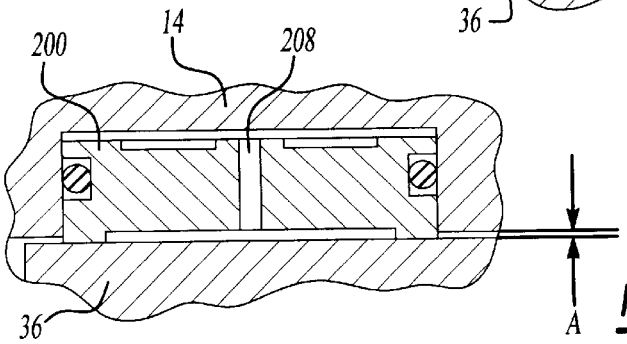
Fig-9C

PRESSURE ACTUATED SEAL

BACKGROUND OF THE INVENTION

The scroll compressor has become widely accepted in home and commercial air conditioning systems. In such a compressor, two scroll elements, each having a wrap, are driven so that one scroll element is in orbital motion relative to the other. A series of constantly changing compression pockets are formed between the interacting wraps of the scroll elements that act to compress a refrigerant gas therebetween. Generally, the gas is compressed in moving radially inward from the outer perimeter of the scroll elements to the center thereof.

As the scroll compressor is operated, forces are exerted which urge the scroll elements apart axially along the axis of orbital motion between the scroll elements. This force is commonly resisted by bleeding compressed refrigerant gas from a compression pocket between the wraps of the scroll elements to a chamber formed behind one of the scroll elements. The pressure in the chamber acts on the base of the scroll element to force the scroll elements together. Seals are used to isolate this chamber from the interior of the scroll compressor, which is usually at either the suction or the discharge pressure in the compressor. In one application of this approach, the seals and chamber are located behind the moving, or orbiting scroll. In addition to the sealing action, this design also requires the seals to withstand the sliding action of the orbiting scroll as well as imposing a sliding friction force between the seal and scroll.

While adequate seals have been developed for this purpose, a number of disadvantages exist. One disadvantage is the relatively high starting torque requirement placed on the motor in the compressor in initial start up to overcome the friction between the seal and scroll necessitated by sufficient seal forces to maintain the desired sealing action during the starting transient. The seal forces must be sufficient to maintain the desired sealing action as the compressor is in the starting transient and only a tiny amount of compressed gas is available from the pressure vent to actuate a seal. Other shortcomings are the cost of the seals and providing a sufficient range of motion to the scroll elements while maintaining sealing engagement. A need exists for improved seals which eliminate these disadvantages.

SUMMARY OF THE INVENTION

In accordance with one aspect of the present invention, a pressure actuated seal is provided for a chamber formed between a moving scroll element and a stationary portion of a scroll compressor. Pressure in the chamber urges the scroll element axially into engagement with a mating scroll element to form compression pockets therebetween. The seal includes a seal ring mounted in a recess, formed either in the scroll element or in the stationary portion, for axial movement in the recess. The seal ring has seals for sealing engagement with the walls of the recess as the seal ring moves axially. Structure is provided to move the seal ring into sealing engagement with the element or portion facing the recess during start-up of the compressor. Pressurized fluid from the compression pocket enters the chamber. The chamber forms an enclosed volume defined by the seals between the seal ring and the walls of the recess and the seals between the seal ring and the facing scroll element or stationary portion. The pressurized fluid in the chamber forces the scroll element into engagement with the mating scroll element.

In accordance with another aspect of the present invention, the structure to move the seal ring and scroll element into sealing engagement includes the seal ring having a thickness greater than the depth of the recess so that, during start-up, the pressure in the compression pockets urges the scroll element axially into engagement with the seal ring.

In accordance with another aspect of the present invention, the structure to move the scroll element and seal ring into sealing engagement includes an actuator piston mounted for axial movement within the seal ring. Structure is provided to urge the actuator piston into continuous sealing engagement with the scroll element.

In accordance with another aspect of the invention, the seal ring is formed by two separate seals. The separate seals can be mounted in recesses in the scroll element or in the stationary portion, or one seal in a recess in the scroll element and the other seal in a recess in the stationary portion.

BRIEF DESCRIPTION OF THE DRAWINGS

A more complete understanding of the invention and its advantages will be apparent from the following detailed description when taken in conjunction with the accompanying drawings, in which:

FIGS. 8A, 8B and 8C are partial cross-sectional views of different variations of a scroll compressor showing a pressure actuated seal forming a fifth embodiment of the present invention;

FIG. 9 is a cross-sectional view of a scroll compressor showing a pressure actuated seal forming a sixth embodiment of the present invention;

FIGS. 9A, 9B and 9C illustrate detail views of the seal used in the embodiment of FIG. 9.

DETAILED DESCRIPTION

Figure 1A:
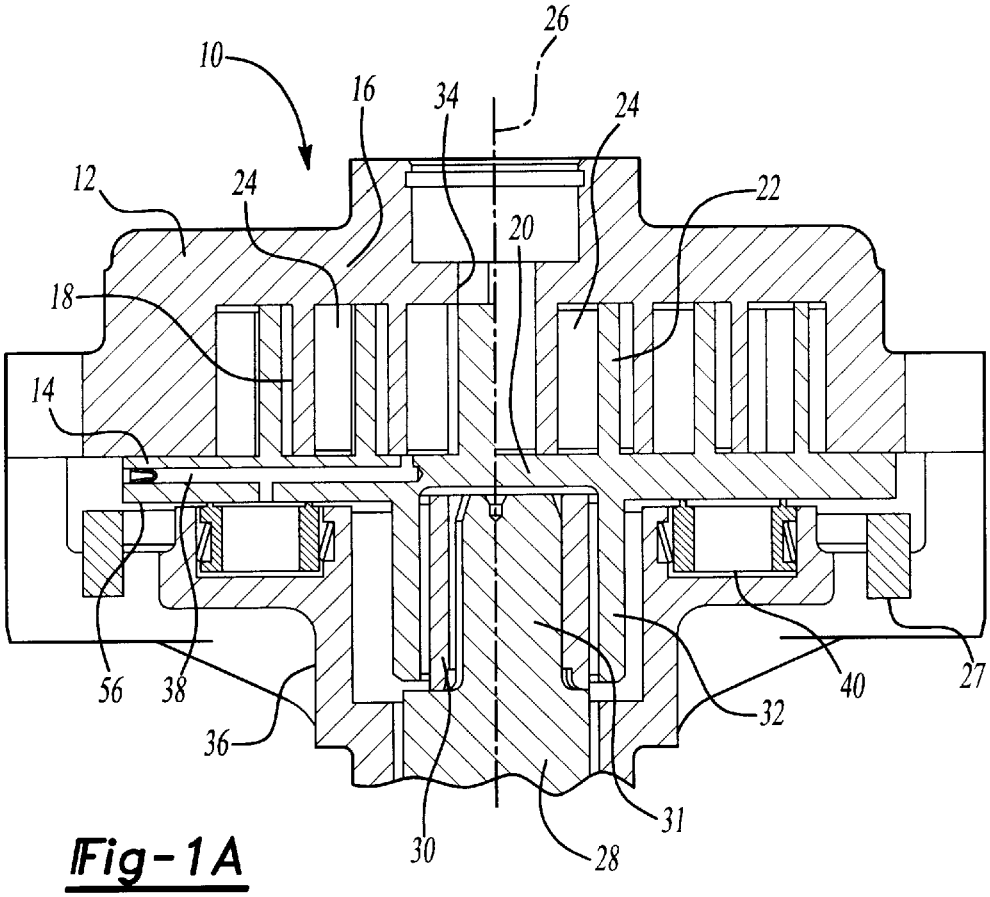
FIG. 1A is a partial cross-sectional view of a scroll compressor showing a pressure actuated seal forming a first embodiment of the present invention.
Figure 1B:
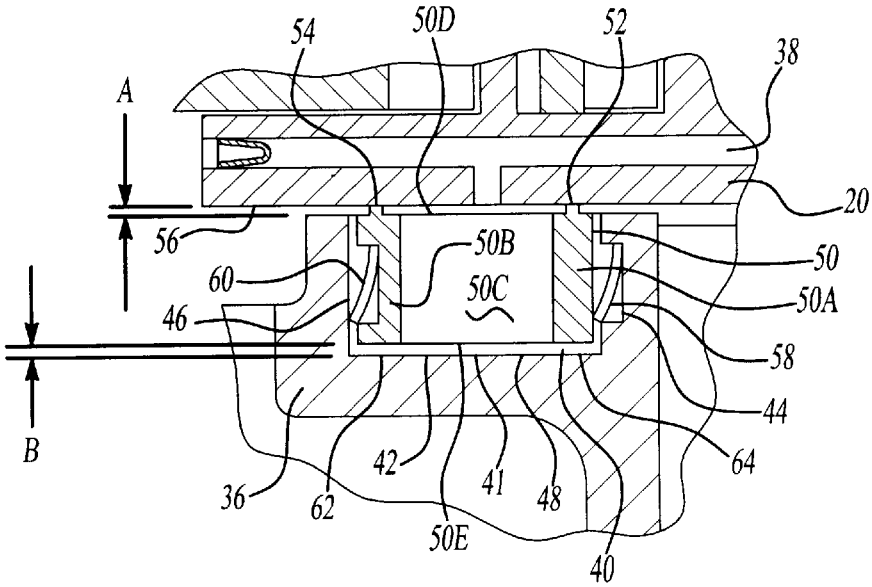
FIG. 1B is a partial cross-sectional view of the pressure actuated seal of FIG. 1A.
Figure 2A:
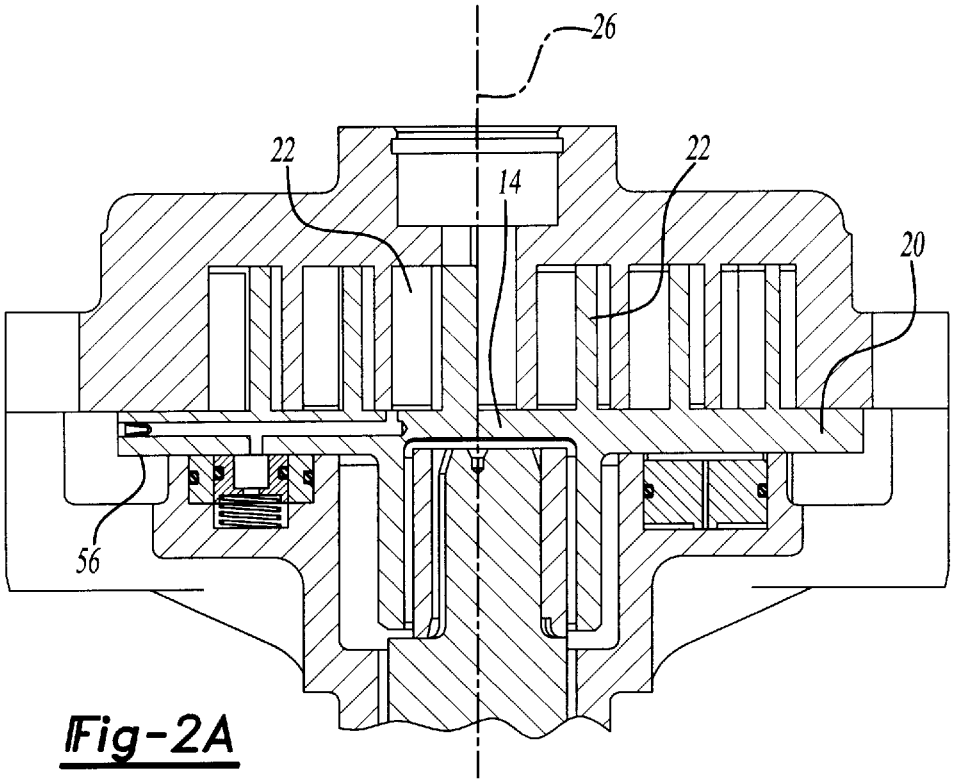
FIG. 2A is a partial cross-sectional view of a scroll compressor illustrating a pressure actuated seal forming a second embodiment of the present invention.
Figure 2B:
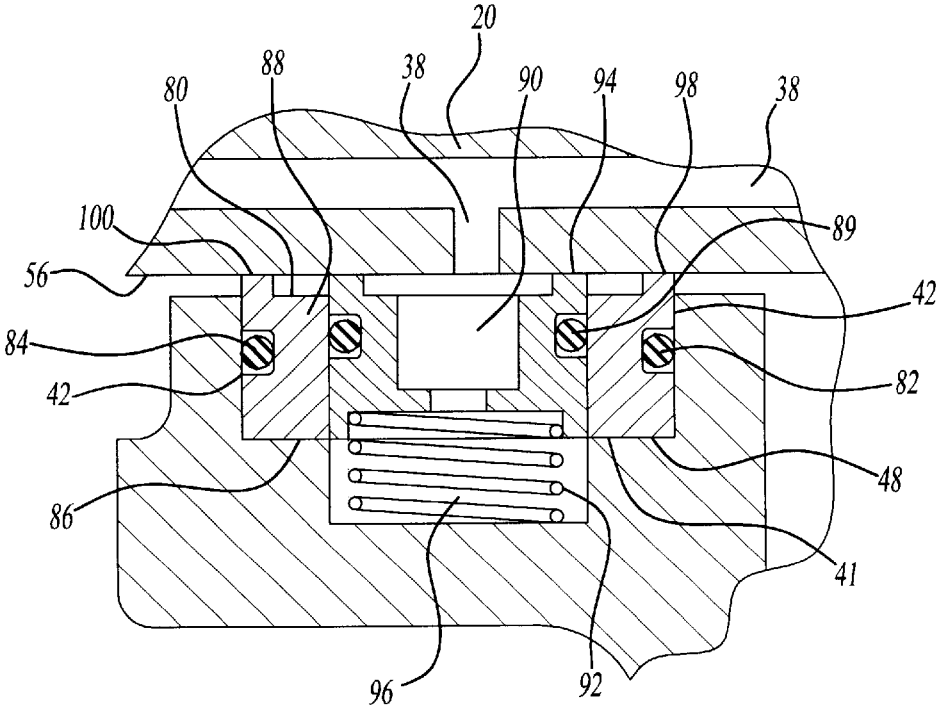
FIG. 2B is a partial cross-sectional view of the pressure actuated seal of FIG. 2A.
Figure 2C:
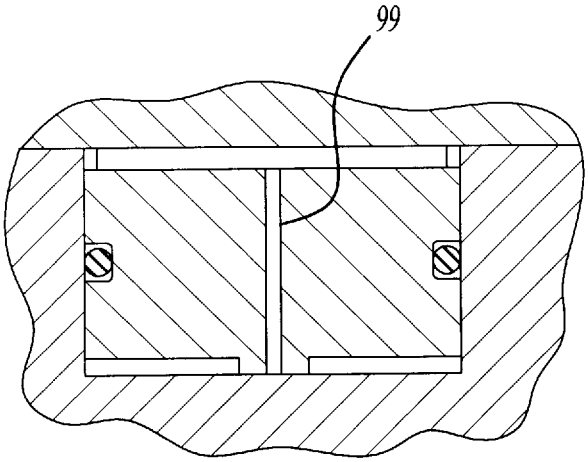
FIG. 2C is an exploded view of the scroll compressor of FIG. 2A.

Referring now to the drawings, wherein like reference characters designate like or corresponding parts through the several views, and in particular to FIGS. 1A and 1B, a scroll compressor 10 is illustrated which forms a first embodiment of the present invention. The scroll compressor has a fixed scroll element 12 and an orbiting scroll element 14 mounted therein. The fixed scroll element has a base 16 and a wrap 18. The orbiting scroll element 14 similarly has a base 20 and a wrap 22. The fixed and orbiting scroll elements 12 and 14 are mounted within the scroll compressor 10 to define a series of compression pockets 24 therebetween.

The orbiting scroll element 14 is mounted within the scroll compressor 10 for orbiting motion about an axis relative to the fixed scroll element 12. A motor (not shown) rotates a drive shaft 28 in crankcase 36 having an offset drive portion 31 received in a slider block 30, which in turn is received in a drive boss 32 extending from the base 20 of the orbiting scroll element 14. The orbiting scroll element 14 is prevented from rotating about the axis 26 by an Oldham coupling 27 or other rotation preventing device.

As the motor is started, the orbiting scroll element 14 begins to orbit relative to the fixed scroll element 12. Refrigerant gas at suction pressure is captured by the scroll element wraps at their outer radius and is compressed in the compression pockets 24 until compressed to the maximum discharge pressure at the center of the scroll element and discharged through discharge port 34.

The orbiting scroll element 24 is provided with an axial running clearance "A" along axis 26 relative to the fixed scroll element 12 and the crankcase 36 of the scroll compressor. The forces within the compression pockets 24 act to drive the orbiting scroll element 14 along the axis 26 away from the fixed scroll element 12, thereby separating the tips of the wraps 18 and 22 from the respective bases 20 and 16 to compromise the sealing integrity of the compression pockets 24. This force is resisted by bleeding off a portion of the gas being compressed through a vent 38 in the base 20 of the orbiting scroll element 14. The gas is supplied to an annular chamber 40 formed between the crankcase 36 and the base 20 of the orbiting scroll element 14 to urge the orbiting scroll element 14 into sealing engagement with the fixed scroll element 12.

The chamber 40 is defined in part by a recess 41 in crankcase 36 having an inner radial wall 44, an outer radial wall 46 and an annular base 48.

An annular, pressure actuated seal 50 is positioned in the chamber for limited axial motion along the axis 26. The pressure actuated seal 50 has an annular inner face seal 52 and an annular outer face seal 54 which can contact and seal against the bottom surface 56 of the base 20 of the orbiting scroll element 14. The pressure actuated seal 50 has an inner diametric seal 58 and an outer diametric seal 60 to seal against the inner radial wall 44 and outer radial wall 46 of the recess 41, respectively. The seal 50 is a unitary piece formed of an inner annular portion 50A, an outer annular portion 50B and a series of connecting, spaced apart radial spokes 50C. The spaced apart spokes 50C insure the pressure on the top 50D and bottom 50E of the seal is the same as gas can freely move through the spaces between the spokes to equalize pressure between the top and bottom of the seal.

The axial thickness of the floating seal 50 along axis 26 is greater than the depth of the recess 41 in the crankcase. The orbiting scroll element has axial running clearance A between the fixed scroll element 12 and crankcase 36. If the pressure actuated seal 50 is moved along the axis 26 until the inner and outer face seals 52 and 54 of the pressure actuated seal 50 contact the bottom surface 56 of the orbiting scroll 14 with orbiting scroll element 14 engaging fixed scroll element 12, the seal 50 extends a distance B from the base 48 of the recess 41. The clearance A exceeds the distance B, permitting the orbiting scroll element 14 to move axially a distance equal only to B prior to the outer annular bottom surface 62 and inner annular bottom surface 64 on pressure actuated seal 50 contacting the base 48 of the recess 41 and preventing any further travel. Thus, the orbiting scroll 14 will never actually contact the crankcase 36 when it is urged away from fixed scroll 12 along the axis 26, but will be restrained by contact with inner and outer face seals 52 and 54 which extend above the top of recess 41 a minimum distance equal to A–B when the outer annular bottom surface 62 and inner annular bottom surface 64 on pressure actuated seal 50 are contacting base 48 of the chamber 40.

As the scroll compressor is started and develops pressure within the compression pockets 24, the orbiting scroll element 14 is moved along the axis 26 toward the pressure actuated seal 50 and crankcase 36. The bottom surface 56 of base 20 on orbiting scroll element 14 contacts the inner and outer face seals 52 and 54, creating sealed chamber 40 which begins to build up pressure through the vent 38 opening into the chamber 40. The chamber 40 is isolated by the inner and outer face seals 52 and 54 and the inner and outer diametric seals 58 and 60.

During start up, the orbiting scroll element 14 may be forced along the axis against the pressure actuated seal 50 until the floating seal 50 bottoms out at the base 48 of the recess 41. Even so, the fact that the inner and outer face seals 52 and 54 extend the distance A–B from the top of the recess 41 will ensure that a seal continues to be made between the orbiting scroll element 14 and the floating seal 50.

As gas pressure increases in the chamber 40, the orbiting scroll element 14 is pushed back along axis 26 against the force of the gas pressure in the compression pockets and forced against the fixed scroll element 12 for normal operation. The force exerted on the orbiting scroll element due to the back chamber pressure is $$P_{backchamber}A_2 + \left[P_{backchamber}(A_1 - A_2) - \frac{(P_{backchamber} + P_{suction})}{2}(A_3)\right]$$

where:

$A_1$ is the total area between of the bottoms of the seal 50;

$A_2$ is the area between the inner and outer face seals 52 and 54;

$A_3$ is the area of the inner and outer face seals 52 and 54;

$P_{backchamber}$ is the pressure in chamber 40;

$P_{suction}$ is the suction pressure to which the portions of seal 50 not within chamber 40 are exposed.

The equation assumes a linear pressure decrement from $P_{backchamber}$ to $P_{suction}$.

In other words, the force exerted on the orbiting scroll element is equal to the reactive force acting between seal element 50 and the orbiting scroll element 14, plus the pressure force defined by the product of the pressure in chamber 40 and the cross-sectional area defined between the inner and outer face seals 52 and 54. For the seal 50 to be statically balanced, the reactive force acting between seal 50 and orbiting scroll element 14 is equal to the product of the difference between the pressure in chamber 40 and suction pressure and the differential cross-sectional area between the areas defined between inner and outer diametric seals 58 and 60 and between inner and outer face seals 52 and 54. Preferably, the seal is designed to provide a minimal net upward force against the orbiting scroll element 14. The end result is a minimal power-loss and minimal frictional forces. Seal wear is also minimized.

The difference in area between the area bounded by the inner and outer diametric seals 58 and 60 and the area bounded by the inner and outer face seals 52 and 54, acted on by the difference in pressure between the pressure within chamber 40 and the suction pressure acting outside the face seals 52 and 54, creates the net upward pressure force on the pressure actuated seal 50 along the axis toward the orbiting scroll element. Due to the net upward pressure force on the pressure actuated seal 50, the pressure actuated seal follows the orbiting scroll in its axial movement. While the pressure actuated seal 50 follows orbiting scroll element 14 axially, the scroll element 14 is also in constant orbital motion about the axis 26. Therefore, the surface 56of the base 20 will be continuously moving relative to the inner and outer face seals 52 and 54.

The area between the diametric seals 58 and 60 is sized for the axial compliance requirement of the scroll compressor. The area between the inner and outer face seals 52 and 54 is only somewhat smaller so that, in the presence of the pressure in chamber 40, there is a net load acting upward on the seal sufficient to force the pressure actuated seal to remain in sealing engagement with the orbiting scroll element but preferably a force no larger than that to minimize friction losses and wear.

The present configuration provides a seal which is self-activated by operating pressures only, avoiding problems that may exist with activation by magnetic designs or seal friction of spring-loaded designs. Conventional axial compliance seals are often preloaded against the sealing surface and thus have high static friction on start-up, frequently requiring a start assist. The present design avoids such a drawback. At start-up, as the pressure actuated seal 50 may not even be in contact with the orbiting scroll element 14, the start-up resistance due to seal friction is minimized. Even if the pressure actuated seal 50 is in initial contact with the orbiting scroll element 14, the sealing forces between the face seals 52 and 54 and the orbiting scroll element 14 only begin to rise after axial movement of the orbiting scroll element 14 occurs due to pressurization within the compression pockets 24. While the pressure actuated seal 50 may bottom out at the base 48 of the recess 41 due to the movement of the orbiting scroll element 14, sufficient pressure can build up in the chamber 40 to lift the orbiting scroll element back into contact with the fixed scroll element.

With reference now to FIGS. 2A, 2B, 2C and 2D, a second embodiment of the present invention will be illustrated and described. In this embodiment, a pressure actuated seal 80 is positioned in the annular recess 41. The pressure actuated seal 80 is annular and has an inner diametric seal 82 and an outer diametric seal 84. While illustrated as o-rings, the seals 82 and 84 can alternatively be a lip seal, a flip seal or other suitable seal.

The pressure actuated seal 80 has an axially extending cylindrical cavity 86 through a portion thereof which receives an actuator piston 88. The actuator piston 88 slides within cavity 86 for independent axial motion relative to the pressure actuated seal 80 and is sealed thereto by o-ring seal 89 or other suitable seal. The actuator piston 88 has an aperture 90 which is formed therethrough. The aperture 90 is continuously positioned over the vent 38 in the orbiting scroll element 14. An actuator spring 92 acts between the base of a recess 96 in the crankcase and the actuator piston 88 to continuously bias the actuator piston 88 into contact with the bottom surface 56 of the base 20 of the orbiting scroll element 14. The actuator piston 88 has a circular face seal 94 which forms a seal against the base 20 surrounding the vent 38. As can be seen, recess 96 and a portion of the recess 41 are isolated by the diametric seals 82 and 84, the seal 89 and the face seal 94 to form chamber 40.

At start-up, the vent 38 discharges pressurized gas from a compression pocket 24 which immediately begins to pressurize the chamber 40, including recess 96. As it increases, the pressure actuated seal 80 will be moved axially toward the orbiting scroll element 14 and inner and outer face seals 98 and 100 on the pressure actuated seal 80 will move into sealing engagement with the surface 56 of the orbiting scroll element 14. The seal 80 then moves orbiting scroll element 14 into contact with the fixed scroll element.

Figure 2D:
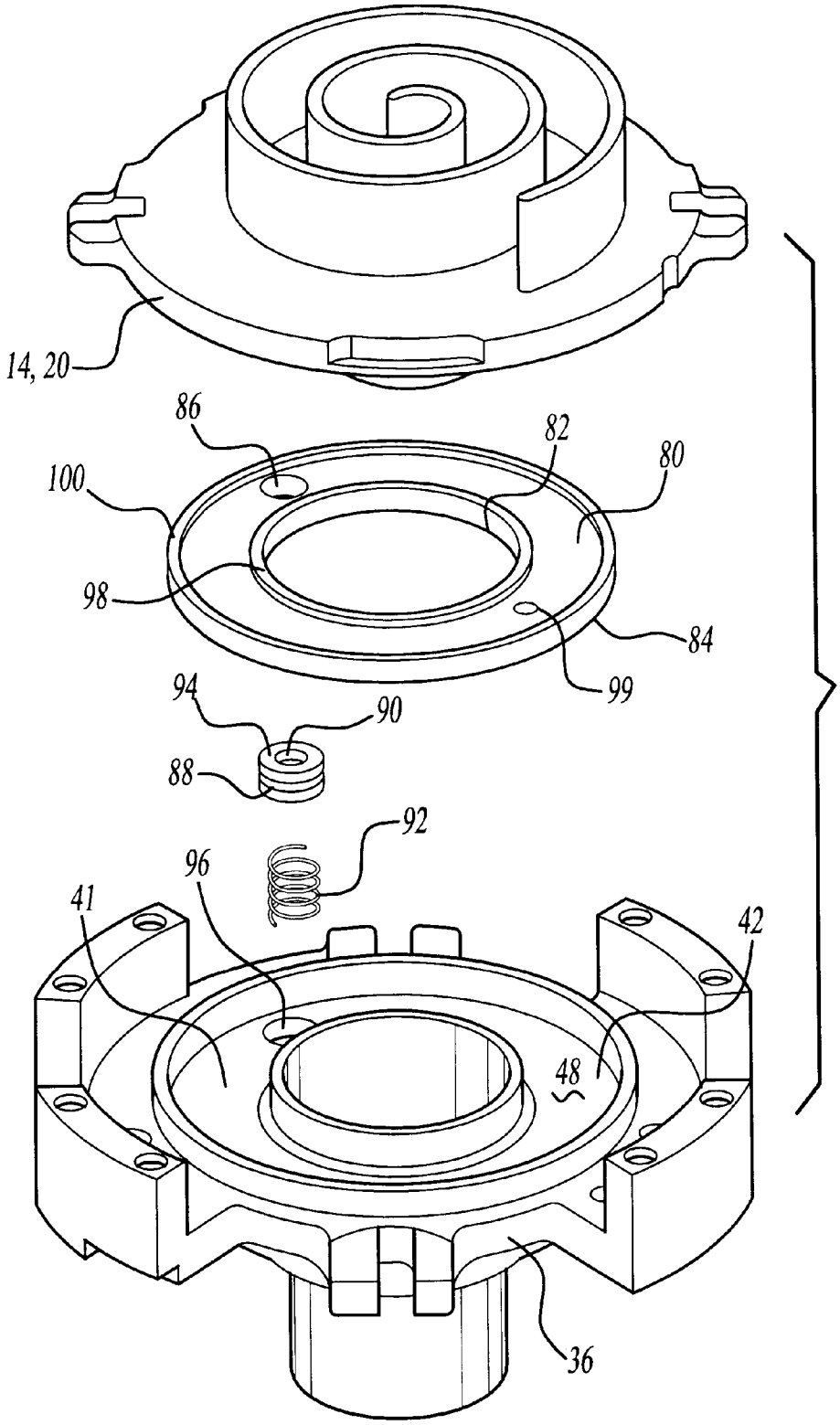
FIG. 2D is a detail view of the pressure actuated seal.

A vent 99 through a portion of the pressure actuated seal 80 spaced from cavity 86, as seen in FIG. 2D, will equalize the pressures between the face seal 94 and face seals 98 and 100. The pressure actuated seal 80 must lift off of the base 48 of recess 41 to uncover vent 99 before equalization can occur. Alternatively, or additionally, the pressure between face seal 94 and face seals 98 and 100 can be equalized due to bypass leakage between the actuator piston 88 and the wall of cavity 86, depending on the amount of leakage past seal 89.

Figure 5A:
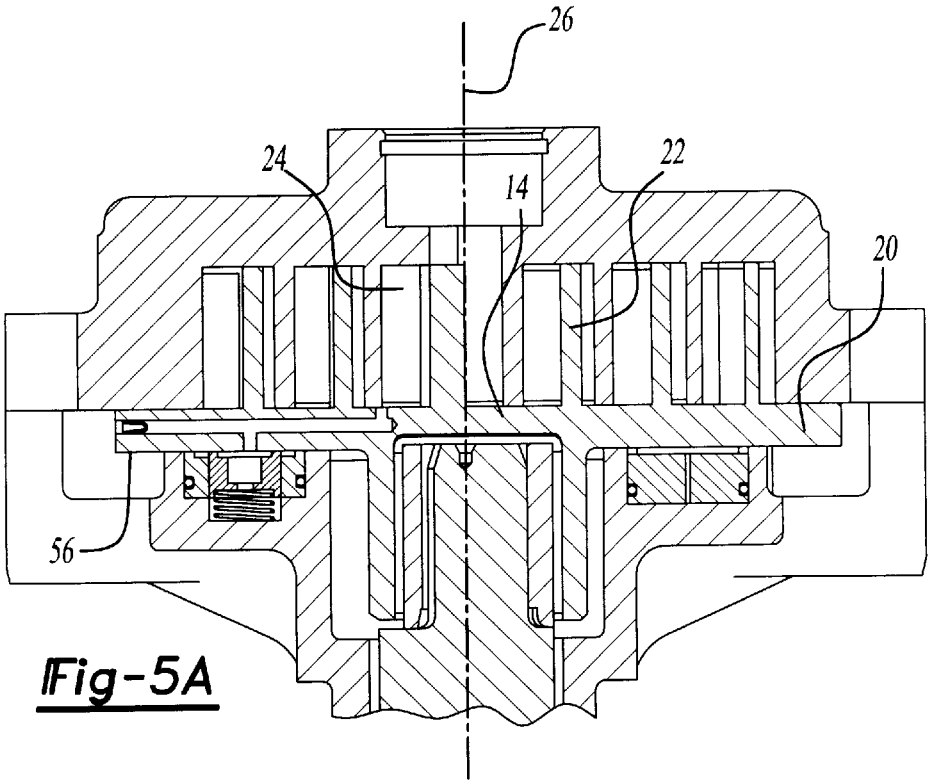
FIG. 5A is a partial cross-sectional view of a scroll compressor showing a pressure actuated seal forming a third embodiment of the present invention.
Figure 5B:
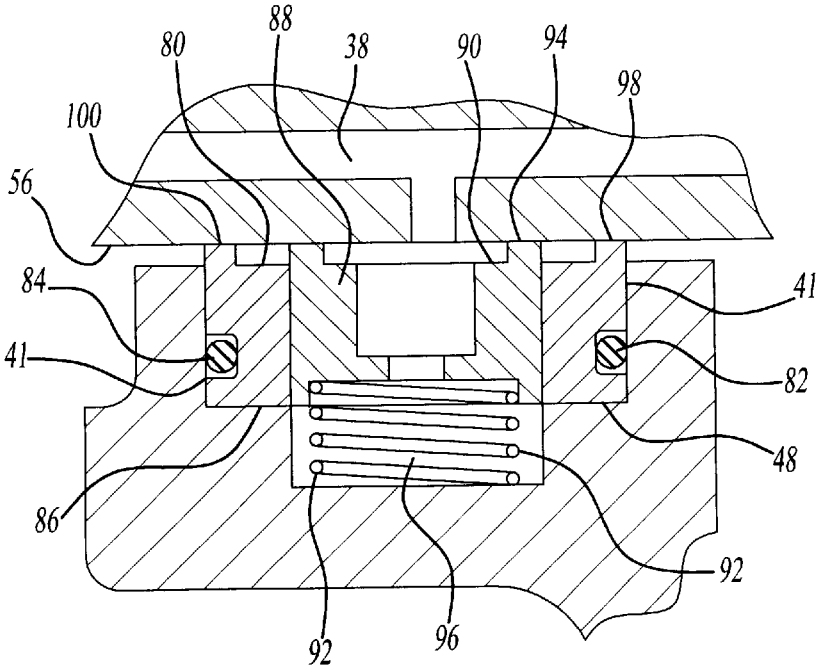
FIG. 5B is a cross-sectional view of the seal ring of FIG. 5A.

In the third embodiment, illustrated in FIGS. 5A and 5B, leakage between the actuator piston 88 and the walls of cavity 86 is permitted through the absence of a seal, such as seal 89. As long as the leakage flow between the actuator piston 88 and the cavity 86 is less than the flow from the vent 38, the pressure will be assured to increase in chamber 40. In this design, it is not necessary to have a vent 99.

The actuator spring 92 need only be a very weak spring, for example 2 to 3 pounds force, to ensure an adequate seal for start-up. The actuator piston 88 may be, for example, one-half inch in diameter.

These designs have a number of advantages. They reduce compression starting torque requirements. The seal cost is minimized. In addition, the seal wear is minimized.

Figure 3:
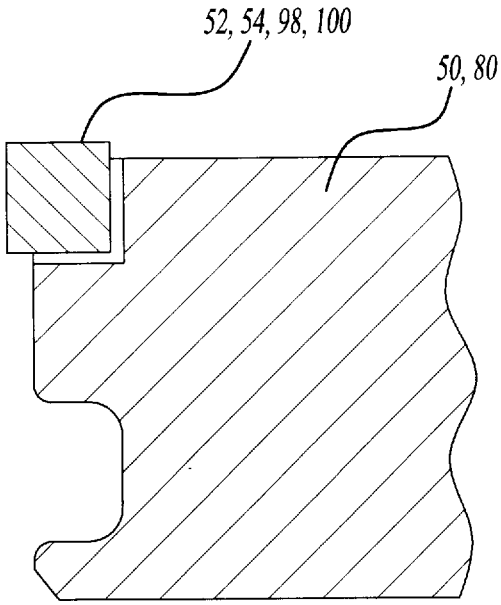
FIG. 3 is a cross-sectional view of one embodiment of an outer face of the seal ring of FIG. 2.

The pressure actuated seals 50 and 80 can be made of numerous materials, including cast iron, plastic (such as TFE) or engineering resin (such as Torlon) or a combination thereof. As illustrated in FIG. 3, the pressure actuated seals 50 and 80 can be a plate formed of cast iron while the inner and outer face seals 52, 98 and 54, 100 are formed of TFE.

Figure 4:
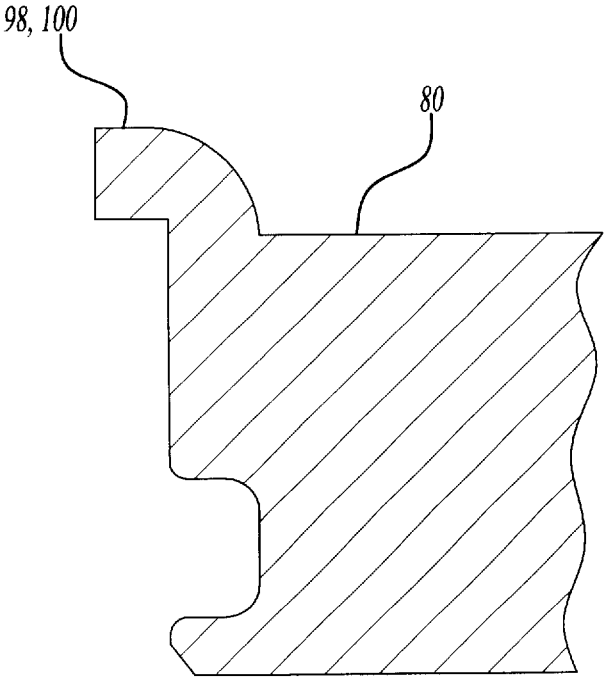
FIG. 4 is a cross-sectional view of another embodiment of an outer face seal.

The pressure lifts the orbiting scroll element 14 into operable engagement with the fixed scroll element 12. By extending the face seals 98 and 100 of seal 80 so that the outermost and innermost radii are equal to that of the diametric seals 82 and 84, a balanced configuration can be provided, as seen in FIG. 4. As the actuator spring 92 provides a constant force on piston 88 to engage the orbiting scroll element 14, there is not a need for the pressure actuated seal 80 to as closely follow the axial motions of the orbiting scroll element as floating seal 50 during start-up. The actuator spring 92 could be eliminated by adding magnetic attraction between the actuator piston 88 and the orbiting scroll element 14, if desired.

While the pressure actuated seals 50 and 80 have been illustrated and described as being operable between the orbiting scroll element and the crankcase of the scroll compressor, it will be clear that the pressure actuated seals can be used between the crankcase or other fixed structure within the compressor and the fixed scroll element if the fixed scroll element is permitted axial movement. Similarly, the pressure actuated seals could be used between the orbiting and fixed scroll elements if a portion of one of the scroll elements extended around the back portion of the other scroll element sufficient to provide the necessary force direction to move the scroll elements into engagement. Also, the pressure actuated seals could as well be used in a compressor using co-orbiting scroll elements.

Figure 6:
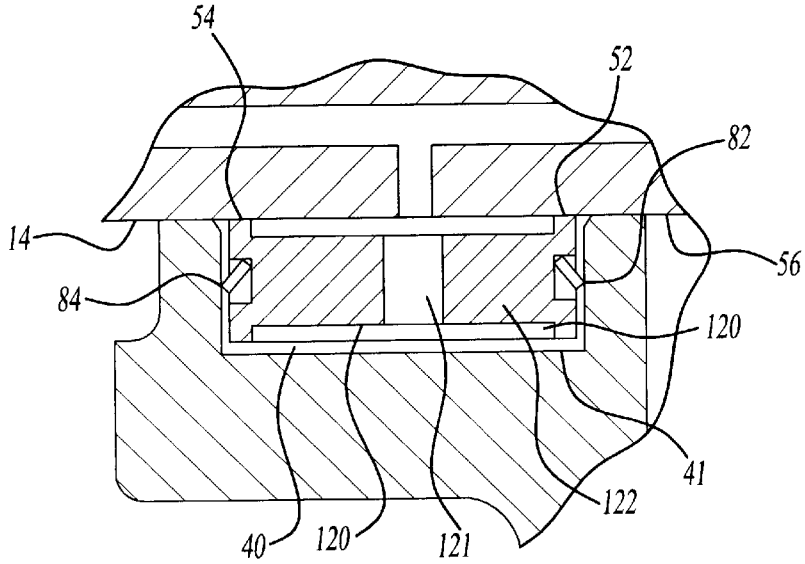
FIG. 6 is a partial cross-sectional view of a scroll compressor showing a pressure actuated seal forming a fourth embodiment of the present invention.

With reference to FIG. 6, another embodiment of the present invention is illustrated which incorporates a magnetic plate 120 within a modified pressure actuated seal 122 which continuously attracts the seal 122 to the orbiting scroll element 14. A vent 121 is formed through the seal 122. In this embodiment, the thickness of the pressure actuated seal 122 does not need to be greater than the depth of the annular recess 41. The magnetic attraction between magnetic plate 120 and the orbiting scroll element 14 will maintain the engagement between the face seals 52 and 54 and the surface 56 of orbiting scroll element 14.

The pressure actuated seal 122 can be made of any material, such as cast iron, steel or plastic, as long as the material of magnetic plate 120 is magnetizable. Alternatively, a magnet can be mounted in the orbiting scroll element 14 to attract the pressure actuated seal 122 as long as the seal 122 includes a material attracted by the magnet.

Figure 7A:
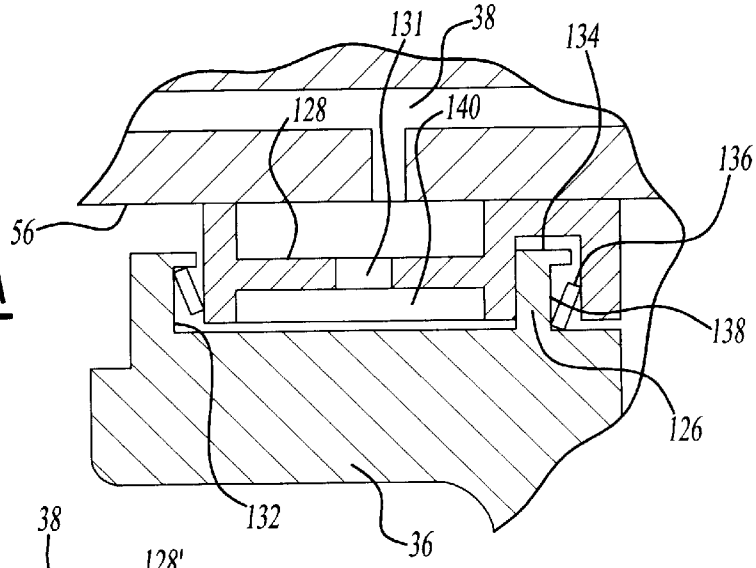
FIG. 7A is a partial cross-sectional view of a modified seal for the embodiment of FIG. 6.

With reference to FIG. 7A, a modification of the embodiment of FIG. 6 is illustrated. In this embodiment, the crankcase is formed with upstanding outer annular ridge 124 and inner annular ridge 126 rather than forming an annular recess 41. The pressure actuated seal 128 has an outer flip seal 130 or other suitable seal to seal against the radially inner surface 132 of the outer annular ridge 124. A vent 131 is formed through the seal which is aligned with vent 38. The pressure actuated seal 128 also defines an annular cavity 134 fitting over the inner annular ridge 126 and having a seal 136 mounted thereon in engagement with the inner surface 138 of the inner annular ridge 126. An annular chamber 140 is thus defined between the crankcase and the floating seal 128.

Figure 7B:
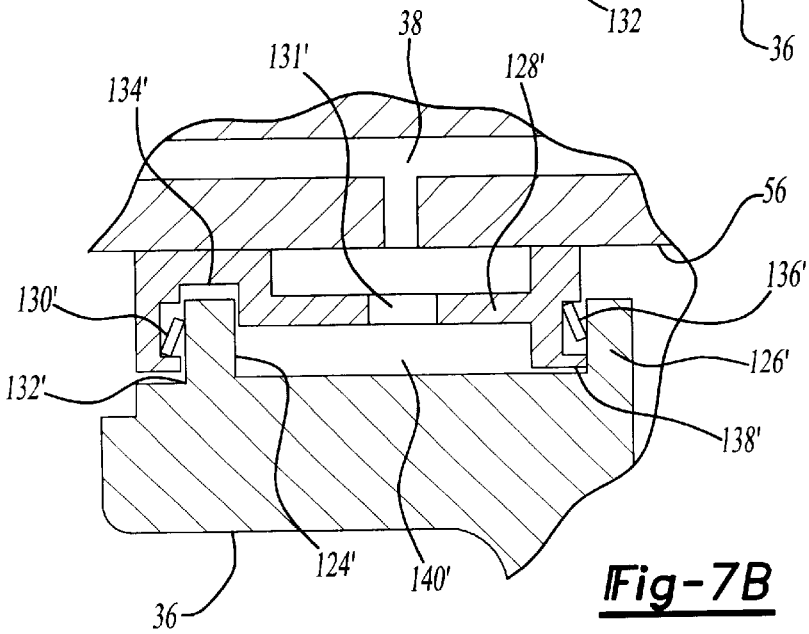
FIG. 7B is a partial cross-sectional view of another modified seal for the embodiment of FIG. 6.

FIG. 7B illustrates a modification of the device in FIG. 7A where the crankcase is formed with upstanding outer annular ridge 124' and inner annular ridge 126'. A pressure actuated seal 128' has an inner flip seal 136', or other suitable seal, to seal against the radially outer surface 138' of the inner annular ridge 126'. A vent 131' is formed through the seal which is aligned with vent 38. The pressure actuated seal 128' also defines an annular cavity 134' fitting over the outer annular ridge 124' and having a seal 130' mounted thereon in engagement with the outer surface 132' of the outer annular ridge 124'. An annular chamber 140' is thus defined between the crankcase and the floating seal 128'.

With reference now to FIG. 8A, another embodiment of the present invention is illustrated. In this embodiment, pressure chamber 40 is defined between two concentric pressure actuated seals 150 and 150' received in recesses 41 and 41' in the crankcase, respectively. Pressure actuated seal 150 is the radially inner seal while pressure actuated seal 150' is the radially outer seal. The pressure actuated seal 150 is formed of a central sealing element 152 and a ring-shaped insert 154. The central sealing element 152 is a conventional diameter-type seal having an inner radial sealing surface 156 and an outer radial sealing surface 158. The ring-shaped insert 154 has an inverted L-shaped cross-section. The portion 160 of the insert 154 which parallels the axis 26 engages the outer radial sealing surface 158 of the sealing element 152. The inner radial sealing surface 156 seals against the inner radial wall 46 of the recess 41. When the floating seal 150 is fully seated within recess 41, the bottom edge 162 of portion 160 contacts the base 153 of recess 41. When fully seated, a rib 164 extending axially from the portion 166 of the insert 154 extending radially extends above the rim of the recess 41. The orbiting scroll element 14 is moved into sealing contact with the rib 164 during start-up. The pressure actuated outer seal 150' is a mirror image of pressure actuated inner seal 150.

The vent 38 discharges pressurized gas into chamber 40 defined between the crankcase 36, orbiting scroll element 14, and the ribs 164, 164' and sealing lips 156 and 156' of seals 150 and 150'. The face seals formed between the ribs 164 and 164' and the orbiting scroll element 14 allow relative lateral sliding motion between the orbiting scroll element 14 and the pressure actuated seals 150 and 150' as the scroll orbits. As the pressure actuated seals 150 and 150' float in motion with the orbiting scroll element 14, the thickness of the portion 166 is designed so that the gap 170 between the end 172 of the portion 166 and the radial walls 46 and 46' of the annular recesses 41 and 41' is always maintained small to prevent seal extrusion. The difference in diameter defined between the ribs 164 and 164' and the low pressure side of the seals at sealing lips 156 and 156' define a net axial load on the seals due to the pressure difference acting across the projected area so that the seals are always pressed against and follow the orbiting scroll element 14. The pressure actuated seals 150 and 150' can be molded from reinforced engineering resin or, for example, screw machined from steel or metal with appropriate wear properties against the orbiting scroll.

FIG. 8B illustrates a variation of the embodiment of FIG. 8A. In this embodiment, the recesses 41 and 41' are formed in the orbiting scroll element 14. Ribs 164 and 164' of the concentric pressure actuated seals 150 and 150' therefore seal against the crankcase 36.

FIG. 8C illustrates yet another modification of the embodiment wherein one of the pressure actuated seals 150 and 150' is mounted in a recess 41 or 41' in the orbiting scroll element 14 while the other is mounted in a recess in the crankcase 36. As illustrated in FIG. 8C, recess 41' is formed in the orbiting scroll element 14 and the annular pressure actuated seal 150' is received therein and recess 41 is formed in crankcase 36 to receive seal 150. However, seal 150' could as well be mounted in a recess 41' in the crankcase 36 while the seal 150 is received within a recess 41 formed within the orbiting scroll element 14.

With reference now to FIGS. 9 and 9A–C, a sixth embodiment of the present invention is illustrated. In this embodiment, a pressure actuated seal 200 can be mounted in a recess 202 formed in the orbiting scroll element 14. The seal 200 can be identical to either seal 50 or seal 80. As illustrated, the seal 200 has a radially inner O-ring seal 204 and a radial outer O-ring seal 206 to seal against the radially inner and radially outer walls of the recess 202. However, seals 204 and 206 can as readily be lip seals or other suitable seals. A port 208 formed in the seal 200 provides equalization between the surfaces of the seal 200. FIG. 9B illustrates the seal 200 against the bottom of the recess 202 before sufficient pressure force is developed to urge orbiting scroll element 14 against scroll element 12. FIGS. 9A and 9C illustrate the seal 200 urging the scroll element 14 against scroll element 12.

Figure 10A:
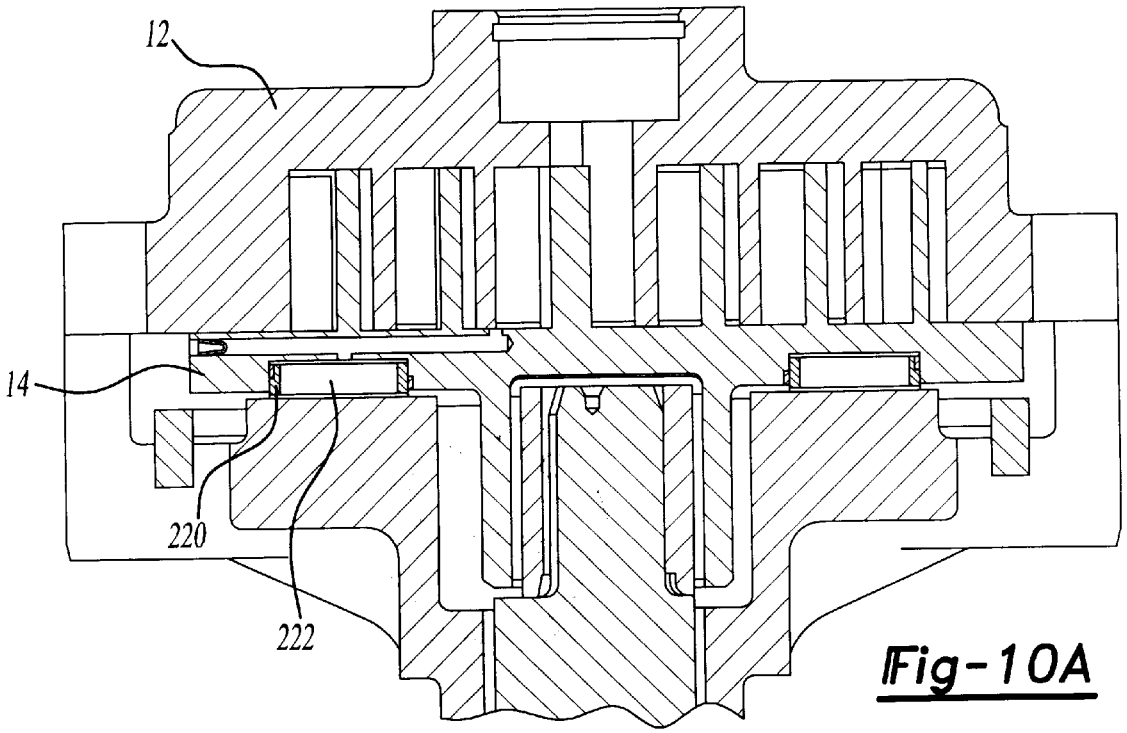
FIG. 10A is a cross-sectional view of a scroll compressor showing a pressure actuated seal forming a seventh embodiment of the present invention.
Figure 10B:
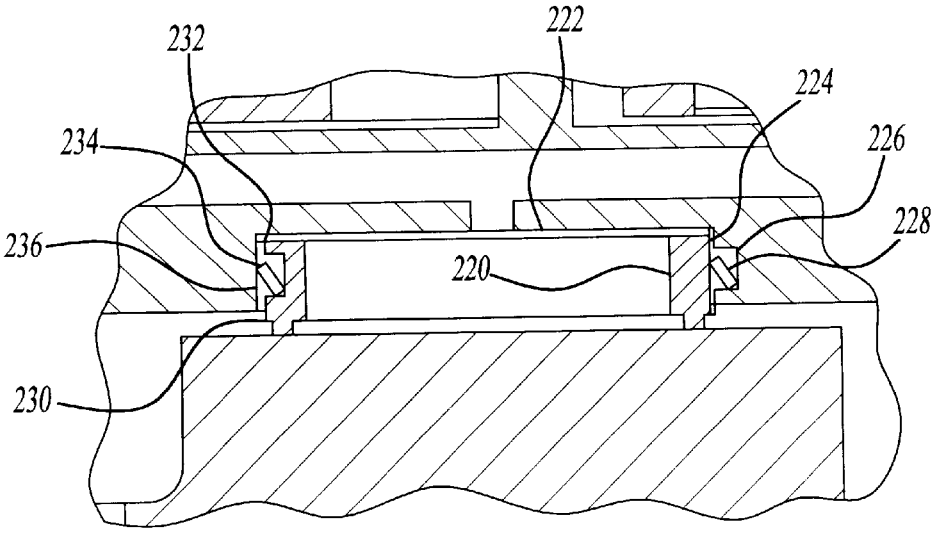
FIG. 10B is a detail view of the seal of FIG. 10A.

With reference now to FIGS. 10A and 10B, a seventh embodiment of the present invention is illustrated which mounts a pressure actuated seal 220 in a recess 222 in the orbiting scroll element 14. As best seen in FIG. 10B, the radially inner wall 224 of the recess 222 is provided with an annular groove 226 which receives a flip seal 228 therein. The radially outer surface 230 of the seal 220 has an annular notch 232 which receives a flip seal 234 to seal against the radially outer wall 236 of the recess 222.

Although several embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing from the scope and spirit of the invention.

What is claimed is:

1. A seal for a chamber formed between a scroll element and another portion in a scroll compressor, the scroll element movable along an axis of orbital motion, one of the scroll element and portion having at least one annular, axially extending surface, pressure in the chamber urging the scroll element axially into engagement with a mating scroll element to form compression pockets therebetween, comprising:

a seal ring engaged with said annular, axially extending surface for axial movement relative thereto, said seal ring having a seal for sealing against said annular, axially extending surface as the seal ring moves axially;

means to move the seal ring and the other one of said scroll element and portion into sealing engagement during start-up of the compressor; and pressurized fluid from a compression pocket entering the chamber forming an enclosed volume defined by the seal between the seal ring and the annular, axially extending surface and a seal between the seal ring and the other one of said scroll element and portion to force the scroll element axially into engagement with the mating scroll element, said means being an actuator piston mounted for axial movement within said seal ring, and means for urging said actuator piston into continuous sealing engagement with the other one of said scroll element and portion.

2. The seal of claim 1 wherein a seal seals between the actuator piston and the seal ring.

3. The seal of claim 1 wherein a gap of predetermined size is formed between the actuator piston and the seal ring to provide controlled leakage therebetween.

4. The seal of claim 1 wherein said means to urge the actuator piston into continuous sealing engagement with the scroll element is a spring.

5. The seal of claim 1 wherein the actuator piston has a passage formed therethrough connecting to a vent hole in the scroll element.

6. The seal of claim 3 wherein a port is formed through the seal ring.

7. The seal of claim 6, wherein said port is offset circumferentially relative to the location of said actuator piston.

8. A scroll compressor comprising:

a first scroll member having a base and a generally spiral wrap extending from said base, said second scroll member being driven to orbit relative to said first scroll member;

a second scroll member having a base and a generally spiral wrap extending from said base;

said wraps of said first and second scroll members interfitting to define compression chambers;

a back pressure chamber behind said base of one of said first and second scroll members, and a tap to said compression chambers extending through said base of said one of said first and second scroll members; and a seal ring at least partially defining said back pressure chamber, said seal ring having annular axially extending surfaces for sealing against a sealing surface to define said back pressure chamber, said seal ring being biased into contact with said sealing surface at start-up of the compressor, and said seal ring having an actuator piston being received within a radial width of said seal ring, and being mounted for relative axial movement within said seal ring, and said actuator piston being urged into engagement with said sealing surface.

9. A scroll compressor as recited in claim 8, wherein said actuator piston is generally cylindrical.

10. A scroll compressor as recited in claim 9, wherein said actuator piston is spring biased toward said base of said one of said first and second scroll members.

11. A scroll compressor as recited in claim 8, wherein said seal ring is mounted within a recess in a housing member positioned adjacent said one of said first and second scroll members.

12. A scroll compressor as recited in claim 8, wherein said back pressure chamber is defined behind a base of said second scroll member.

13. A scroll compressor as recited in claim 8, wherein a seal seals between said actuator piston and said seal ring.

14. A scroll compressor as recited in claim 8, wherein a gap is formed between said actuator piston and said seal ring to provide controlled leakage.

15. A scroll compressor as recited in claim 8, wherein a port extends through said seal ring at a position circumferentially spaced from said actuator piston.

* * * * *